US006205305B1

(12) United States Patent
Suzuki et al.

(10) Patent No.: US 6,205,305 B1
(45) Date of Patent: Mar. 20, 2001

(54) DEVELOPING APPARATUS HAVING WELDED-TOGETHER ACCOMMODATING AND DEVELOPING CONTAINERS

(75) Inventors: Akira Suzuki, Odawara; Hiroomi Matsuzaki, Mishima; Kazuo Chadani, Shizuoka-ken, all of (JP)

(73) Assignee: Canon Kaubshiki Kaisha, Tokyo (JP)

( * ) Notice: Subject to any disclaimer, the term of this patent is extended or adjusted under 35 U.S.C. 154(b) by 0 days.

(21) Appl. No.: 09/346,677

(22) Filed: Jul. 2, 1999

(30) Foreign Application Priority Data

Jul. 2, 1998 (JP) ..... 10-202754

(51) Int. Cl.[7] ..... G03G 15/08
(52) U.S. Cl. ..... 399/106; 399/103
(58) Field of Search ..... 399/102, 103, 399/105, 106, 120

(56) References Cited

U.S. PATENT DOCUMENTS 5,943,529 8/1999 Miyabe, et al. .
6,014,534 * 1/2000 Goebel et al. ..... 399/106

FOREIGN PATENT DOCUMENTS 9-197792 * 7/1997 (JP) .

* cited by examiner

*Primary Examiner*—Quana M. Grainger
(74) *Attorney, Agent, or Firm*—Fitzpatrick, Cella, Harper & Scinto

(57) ABSTRACT

A developing apparatus includes an accommodating container for containing a developer, the container having an opening; a developing container having an opening to which the developer is supplied from the opening of the accommodating container, wherein a developer carrying member for carrying the developer is provided at a developing position; and an elastic sealing member, provided adjacent a longitudinal end of the accommodating container between the accommodating container and the developing container, for preventing to the leakage of the developer. The accommodating container and the the developing container are welded together along the longitudinal direction, and the welded portion includes portions that overlap ends of the elastic sealing member which end in the longitudinal direction.

15 Claims, 11 Drawing Sheets

DEVELOPING APPARATUS HAVING WELDED-TOGETHER ACCOMMODATING AND DEVELOPING CONTAINERS

FIELD OF THE INVENTION AND RELATED ART

The present invention relates to a developing apparatus employable by an image forming apparatus such as a laser printer, which employs an electrophotographic system.

Generally speaking, an image forming apparatus that employs an electrophotographic image formation system also employs a process cartridge system, according to which an electrophotographic photosensitive member, and a processing means for processing the electrophotographic photosensitive member, are integrated in the form of a cartridge, which is removably installable in the main assembly of an image forming apparatus. Also according to this process cartridge system, an image forming apparatus can be maintained by the users themselves without relying on service personnel. Thus, the employment of a process cartridge system drastically improves the operational efficiency of an image forming apparatus. Therefore, a process cartridge system is widely used as the image formation system for an image forming apparatus.

Referring to FIG. 3, such a process cartridge as the one described above comprises two sections: a development frame 12, as a shell for housing a developing means, which holds a development roller 9*b*, and a toner frame 11, as a developer container, which holds toner t. The development frame 12 and the toner frame 11 are joined by ultrasonic welding. More specifically, referring to FIG. 9, either the development frame 12 or the toner frame 11 is provided with a pair of welding ribs 16, which are located, one for one, along the longitudinal edges of the frame, extending in parallel to the longitudinal edges of the opening 80 of the development frame 12 or the opening 81 of the toner frame 11. The welding rib 16 is provided with a director, which is located on the top surface of the rib 16, and this director is melted and fused with the surface of the opposing frame, by ultrasonic welding. Further, the development frame 12 or the toner frame 11 is provided with a pair of elastic members 54 and 56 in the form of a piece of thick tape, which are fixed, one for one, to the longitudinal ends of the frame, with the use of a piece of double-sided adhesive tape or the like. As the two frames are joined by ultrasonic welding, the elastic members 54 and 56 are pinched between the two frames, and seal the gap between the two frames because of their elasticity, preventing the toner from leaking from the longitudinal ends of the cartridge.

However, in the case of a conventional process cartridge, the welded seam is weak across the portion adjacent to the end portion, in terms of the width direction of the process cartridge, of the elastic member for preventing developer leak; and the joint between the development frame and the toner frame does not have sufficient strength or rigidity to hold fast the end of the elastic member. Therefore, toner is liable to leak due to the vibrations that occur as the toner seal is pulled out by a user when a process cartridge is used for the first time, or due to the shock that occurs when a process cartridge is installed into, or removed from, an image forming apparatus.

SUMMARY OF THE INVENTION

The primary object of the present invention is to make it possible for a development frame and a developer frame to be reliably welded across the portion where an elastic seal is positioned, so that it becomes possible to provide a developing apparatus that does not leak toner from the interface between the elastic seal and the development frame or the developer frame.

Another object of the present invention is to reduce the number of areas of the interface between a development frame and a developer frame, across which the two frames are not welded, so that it becomes possible to provide a developing apparatus that does not leak toner.

Another object of the present invention is to make it possible to reliably hold an elastic seal, so that it becomes possible to provide a developing apparatus that does not leak toner.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, a process cartridge in accordance with the present invention, and an image forming apparatus capable of accommodating a process cartridge in accordance with the present invention; ill be described with reference to the appended drawings.

In the following description of the present invention, a term "longitudinal direction" refers to the longitudinal direction of a development frame or a toner frame, and a term "width direction" refers to the direction perpendicular to the longitudinal direction, unless specifically noted.

Embodiment 1

{General Description of Process Cartridge and Image Forming Apparatus Compatible with Process Cartridge}

First, the general structure of an image forming apparatus will be described.

Figure 1:
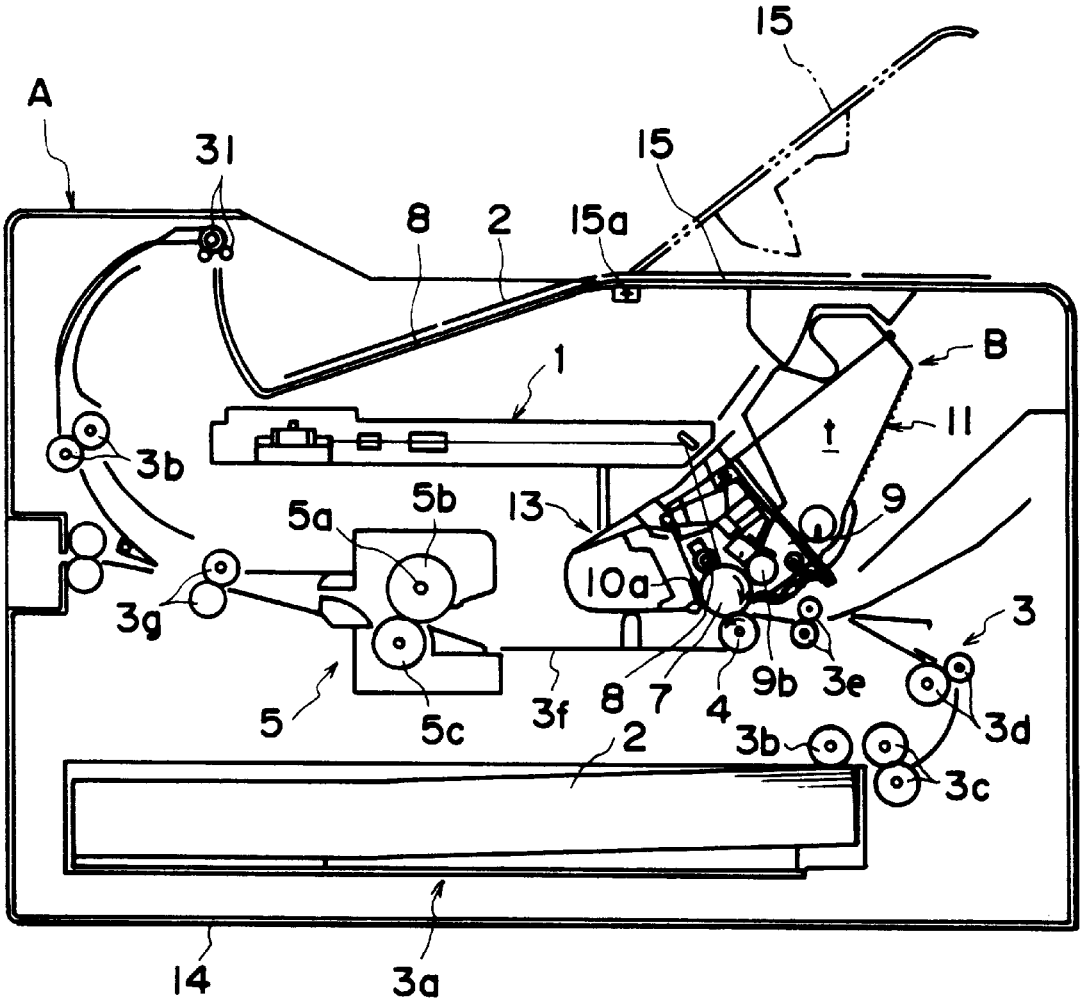
FIG. 1 is a schematic sectional view of a laser printer, a type of image forming apparatus, in which the process cartridge in the first embodiment has been installed.
Figure 2:
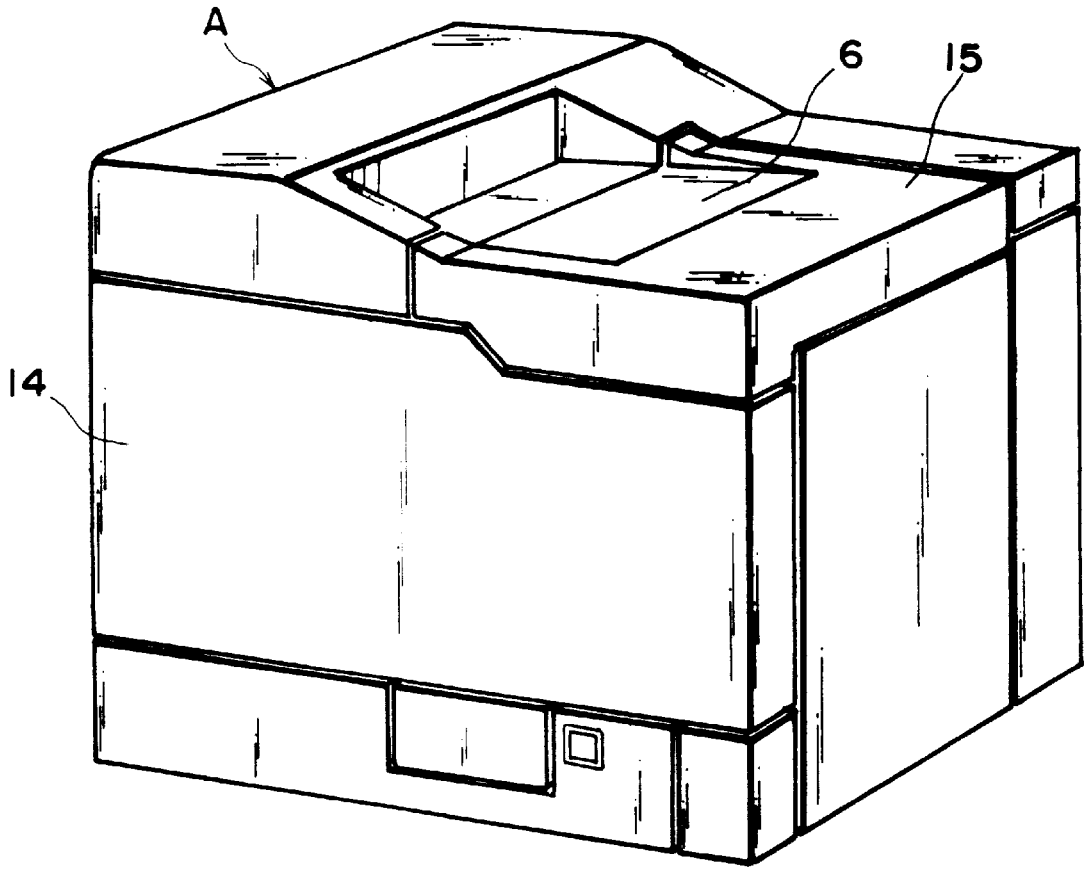
FIG. 2 is an external perspective view of the apparatus illustrated in FIG. 1.

Referring to FIG. 1, an image forming apparatus A forms an image, that is, an image composed of developer (hereinafter, "toner t"), on a photosensitive drum 7, as an image bearing member, by exposing the photosensitive drum 7 to a laser beam projected from an optical system while being modulated with image formation data. Meanwhile, a sheet of recording medium 2 is delivered to the interface between the photosensitive drum 7 and a transfer roller 4 in synchronism with the formation of the toner image; the recording medium 2 is fed out of a sheet feeder cassette 3*a* and conveyed to the interface between the photosensitive drum 7 and a transfer roller 4 by a conveying means 3 consisting of a pickup roller 3*b*, a pair of conveyer rollers 3*c*, a pair of conveyer rollers 3*d*, a registration roller 3*e*, and the like. In the interface, the toner image formed on the photosensitive drum 7 in the Image formation station in a process cartridge B is transferred onto the recording medium 2 by applying voltage to the transfer roller 4 as a transferring means. Thereafter, the recording medium 2 is conveyed, being guided by a guide plate 3*f*, to a fixing means 5, which consists of a driving roller 5*c* and a fixing roller 5*b*. The fixing roller 5*b* contains a beater 5*a*. The fixing means 5 fixes the unfixed toner Image on the recording medium 2 to the recording medium 2 by applying heat and pressure to the recording medium 2 and the toner image as the recording medium is passed through the fixing means 5. Then, the recording medium 2 is conveyed further through a reversing path, and discharged into a delivery tray 6, by pairs of discharge roller 3*g*, 3*h*, and 3*i*.

Figure 3:
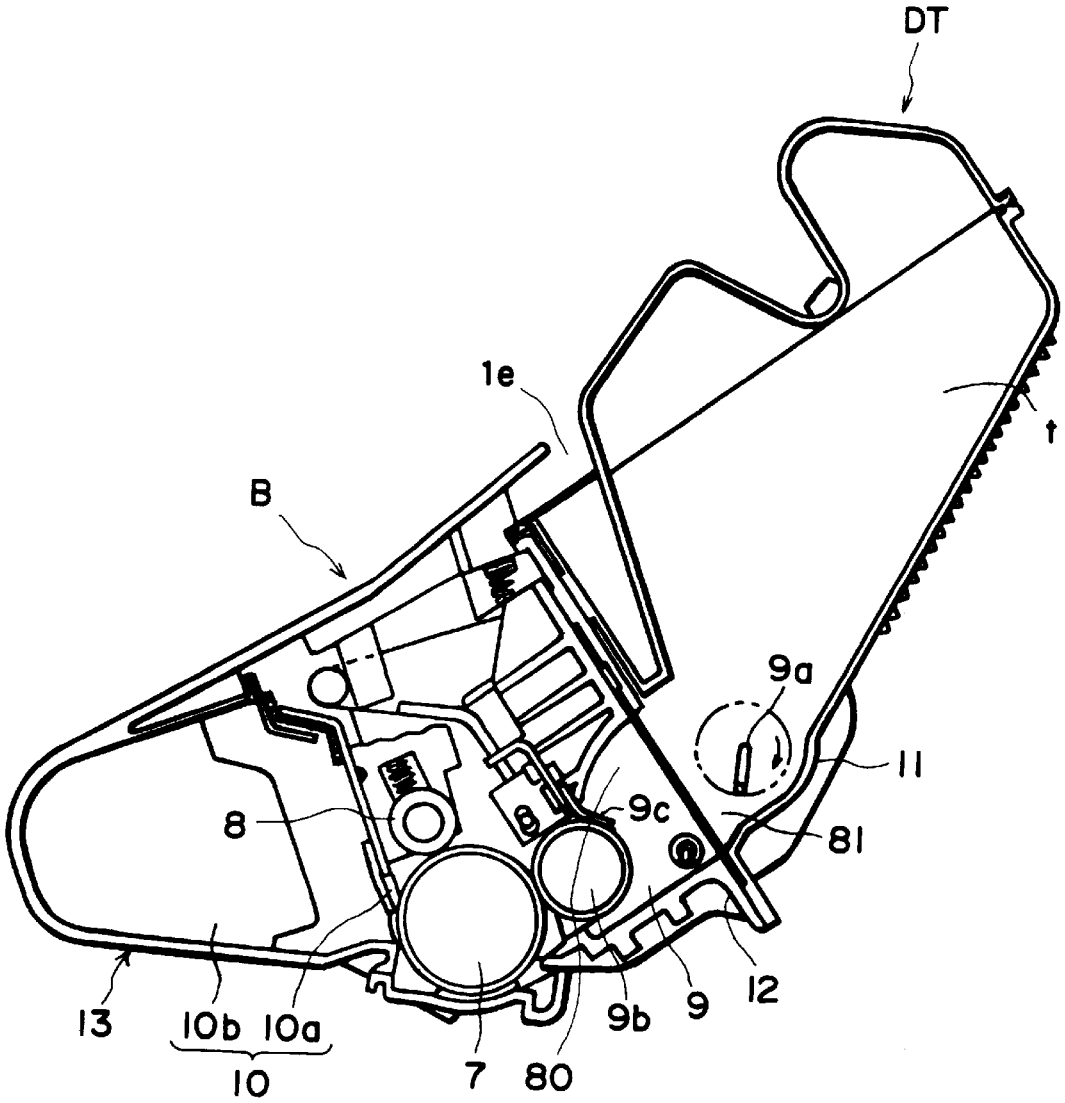
FIG. 3 is a schematic sectional view of a process cartridge in the first embodiment of the present invention.
Figure 4:
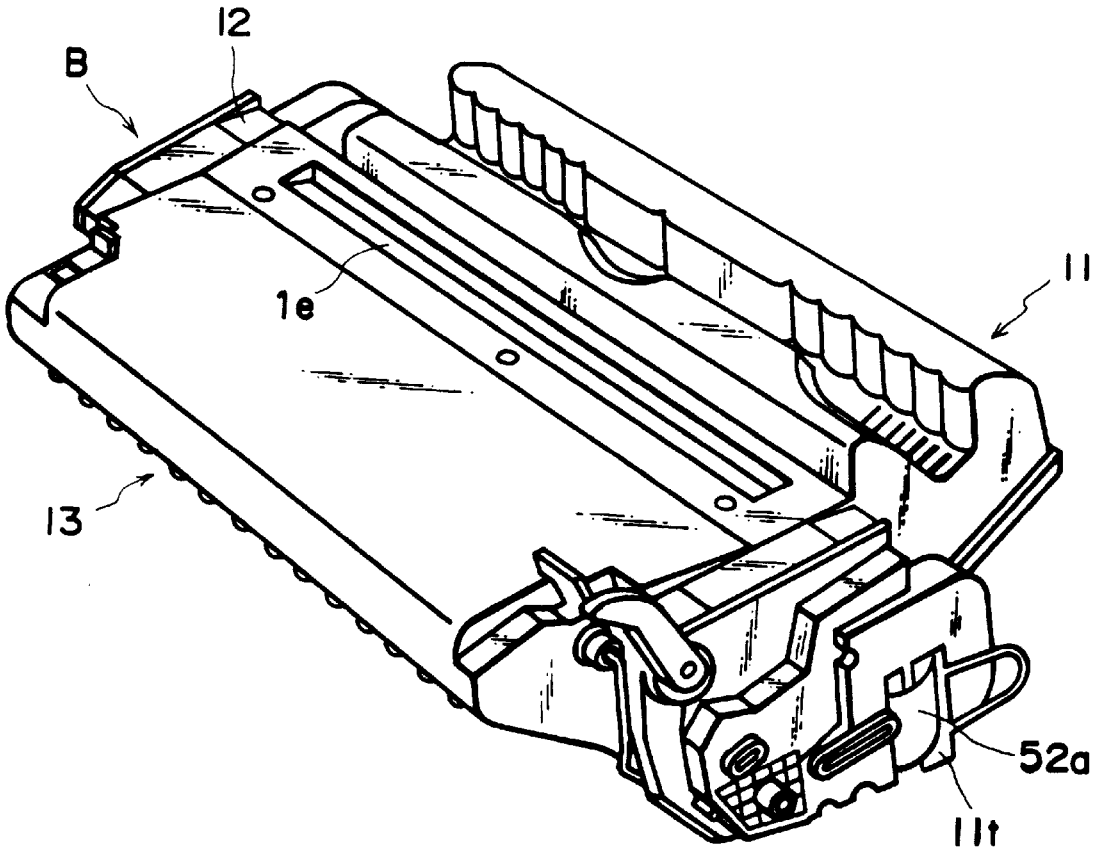
FIG. 4 is an external perspective view of a process cartridge.
Figure 5:
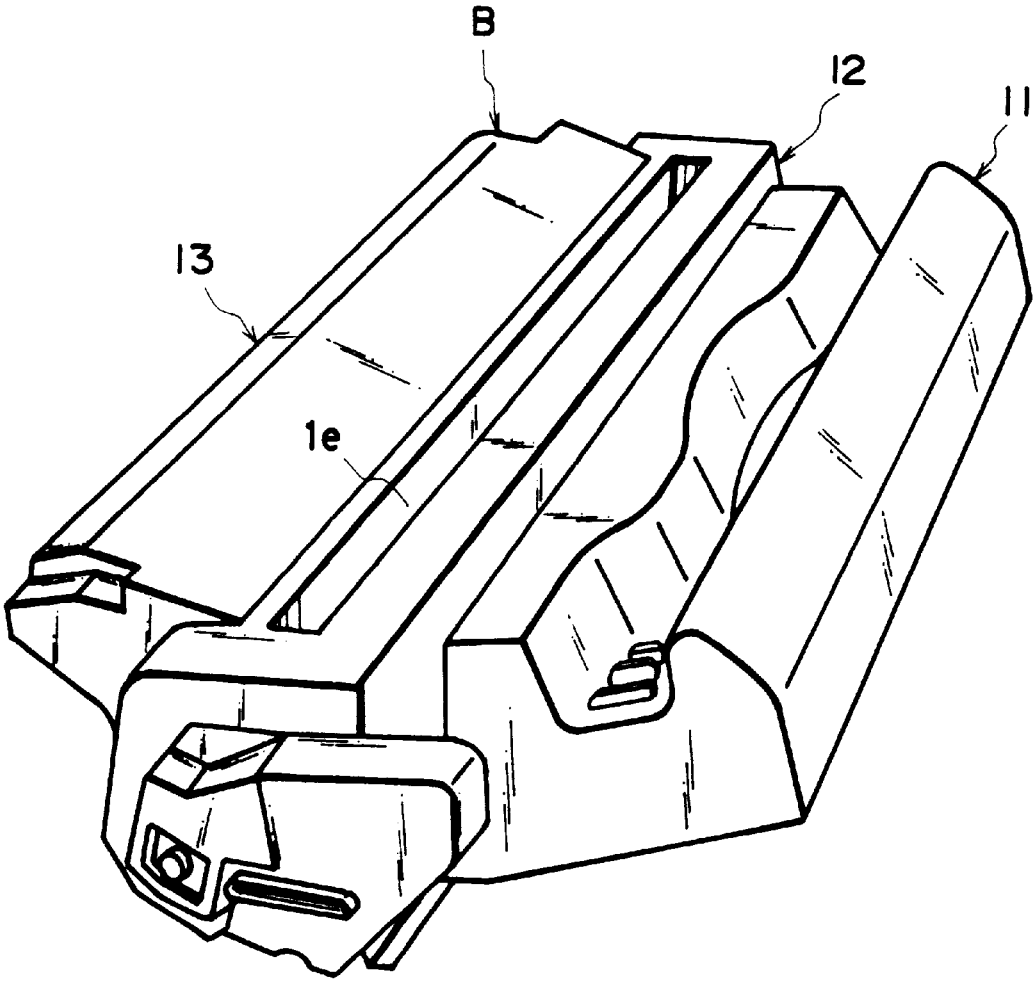
FIG. 5 it also an external perspective view of a process cartridge.

Referring to FIG. 3, in the process cartridge B, which constitutes the image forming portion, the photosensitive drum 7 as the image bearing member is rotated; the peripheral surface of the photosensitive drum 7 is uniformly charged by a charge roller 8; a latent image is formed on the peripheral surface of the photosensitive drum 7 by exposing the peripheral surface to an optical image from the optical system 1, at the exposing station; and a visible image, that is, an image composed of toner, which reflects the latent image, is developed by a developing means 9. Then, the toner image is transferred onto the recording medium 2 by the transfer roller 4. After the toner image transfer, the toner which remains on the photosensitive drum 7 is removed by a cleaning means 10, which comprises, a cleaning blade 10*a* and a waste toner bin 10*b*.

The process cartridge B can be installed into the main assembly 14 of the image forming apparatus by opening the cover 15 upward about a hinge, as shown in FIG. 1.

The process cartridge B consists of three sections: a toner frame 11 (developing container), or the first frame, which comprises a toner reservoir and the like; a development frame 12 (development means container), or the second frame, which holds a development roller 9*b* and the like; and a cleaning frame 13 (cleaning means container), or the third frame, which holds the photosensitive drum 7, the cleaning means 10, and the like.

Next, the individual structures in the image forming apparatus A, and the process cartridge B installable in the apparatus A, will be described in detail.

{Process Cartridge B}

The process cartridge B rotates the photosensitive drum 7, which is an image bearing member; uniformly charges the peripheral surface of the photosensitive drum 7 by the charge roller 8; forms a latent image on the peripheral surface of the photosensitive drum 7 by exposing the peripheral surface of the photosensitive drum 7 to an optical image projected from the optical system 1 of the image forming apparatus A through the exposure opening 1*c*; and develops the latent image into a toner image (visual image) by adhering the toner particles to the latent image from the toner layer with a uniform thickness formed on the development roller 9*b* by the development blade 9*c* as a toner regulating member with which a developing device DT is provided.

After the transfer of the toner image onto the recording medium 2 by the transferring means 4, the toner that remains on the photosensitive drum 7 is removed by the cleaning means 10.

Figure 8:
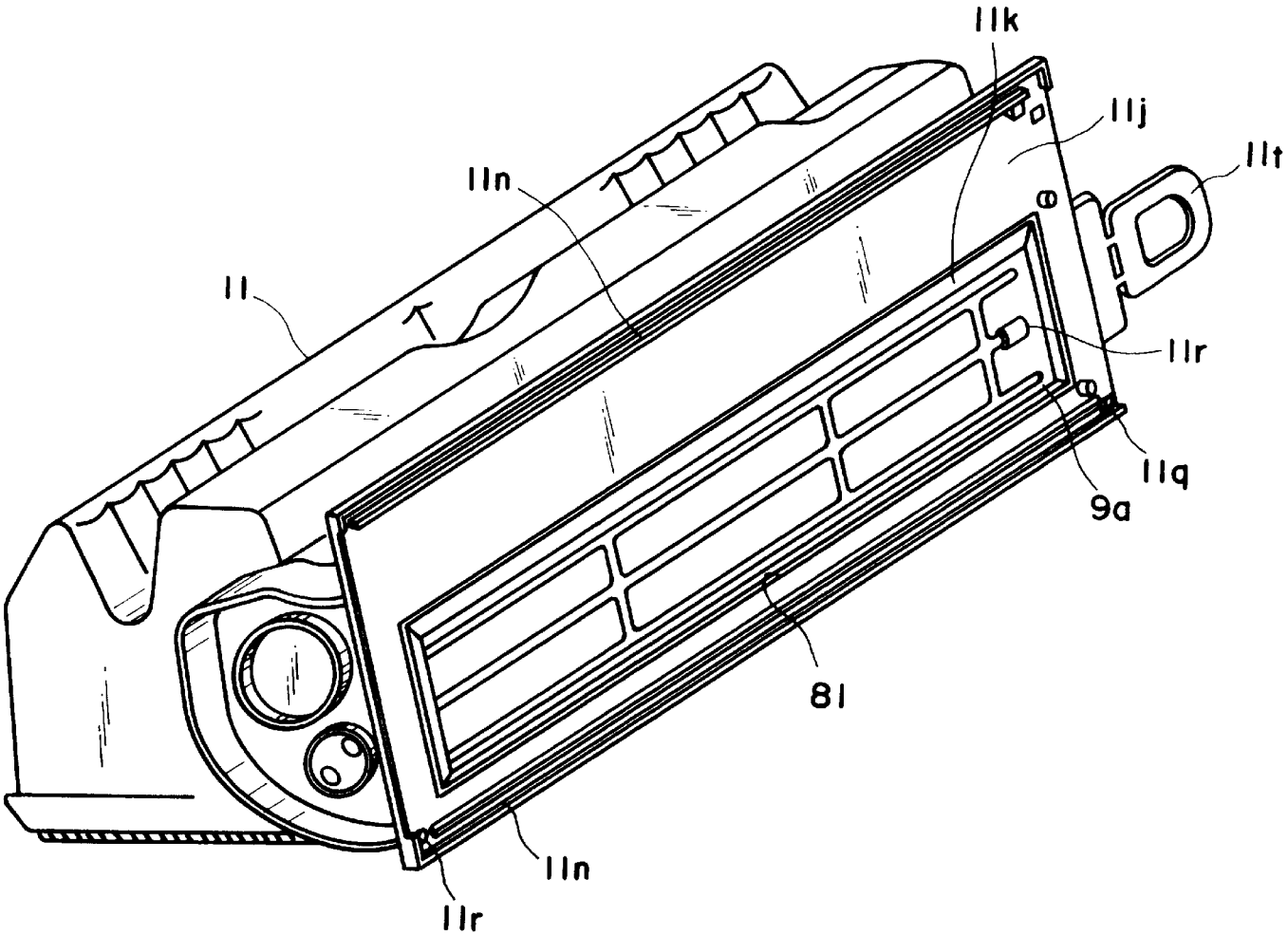
FIG. 8 is a perspective view of a developer container.
Figure 9A:
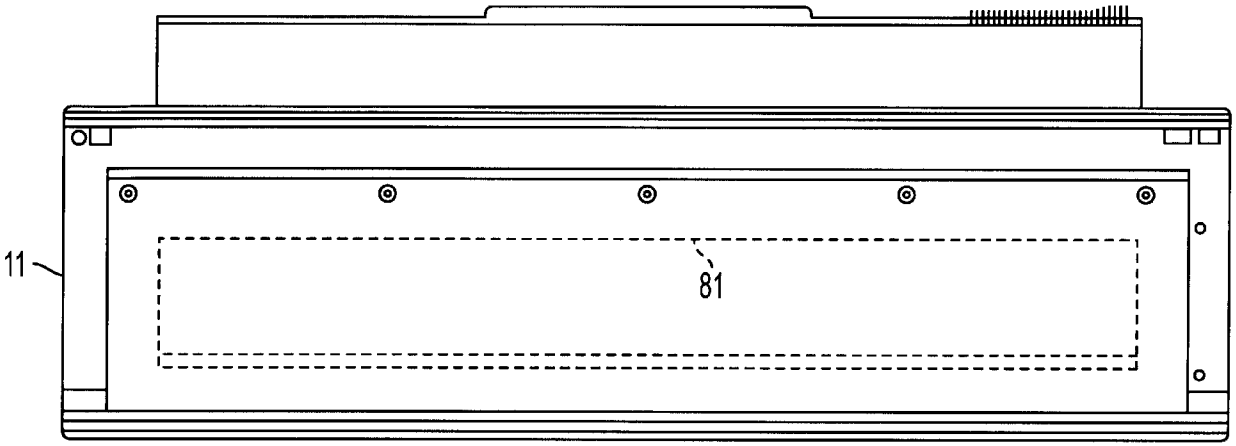
FIG. 9A (PRIOR ART)
FIGS. 9, (*a*) and (*b*), are front views of the developer container and the development means container, of a conventional process cartridge.
Figure 9B:
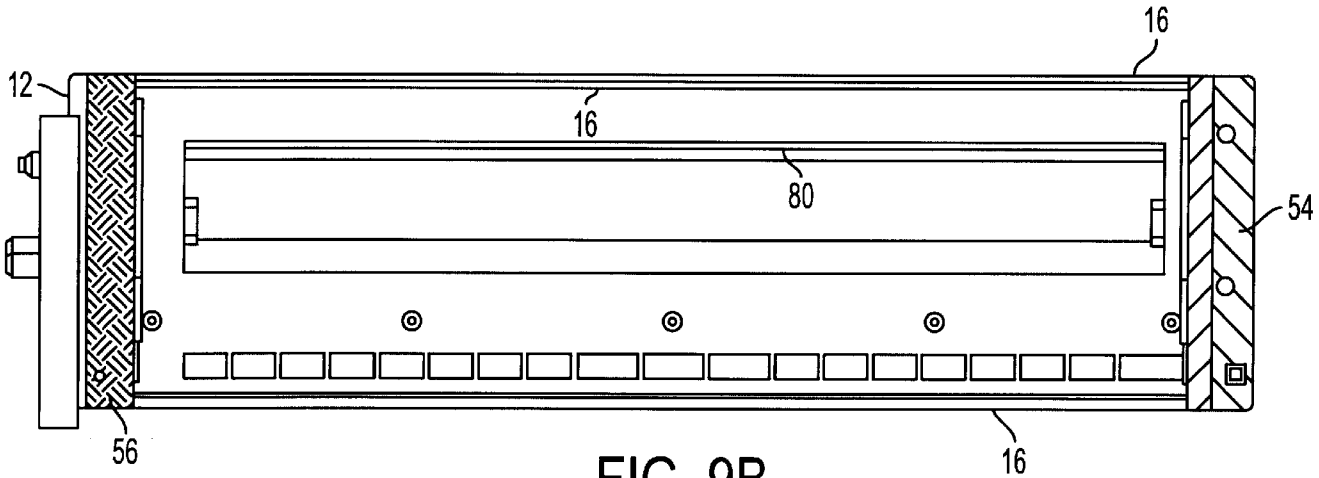
FIG. 9B (PRIOR ART)
Figure 10A:
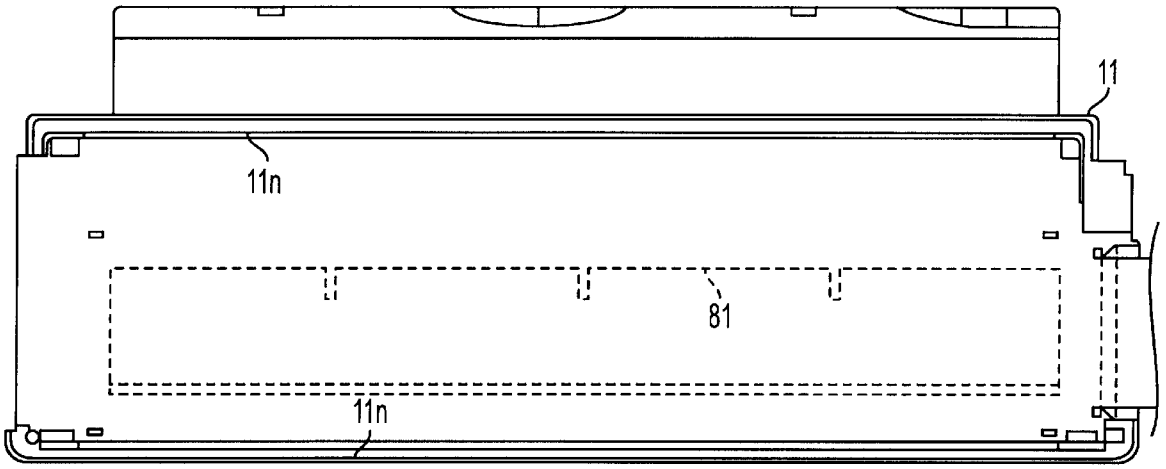
FIGS. 10, (*a*) and (*b*), are front views of the developer container and the development means container, of the process cartridge in one of the embodiments of the present invention.
Figure 10B:
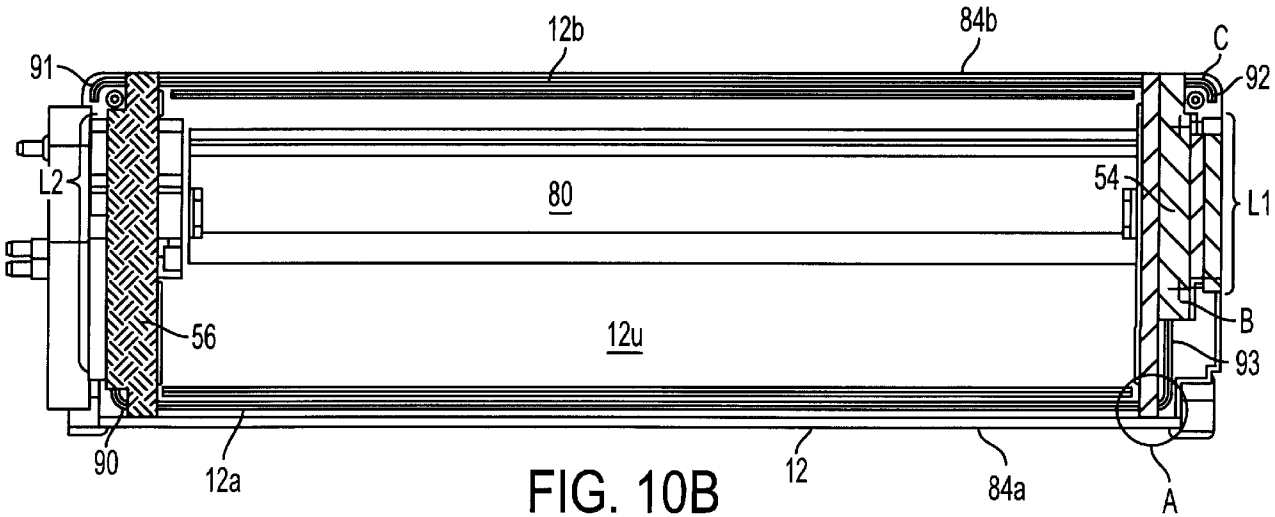
Figure 13:
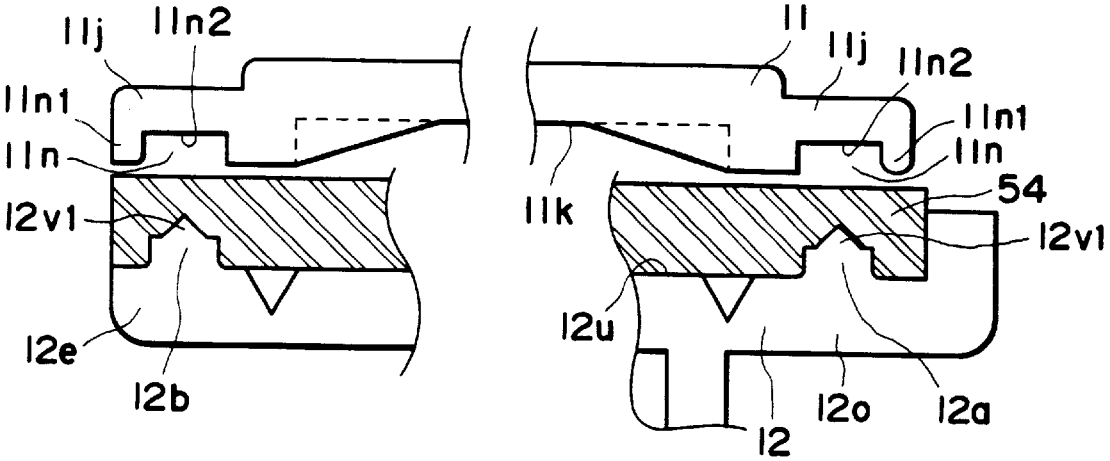
FIG. 13 is a schematic sectional view of the welding portions, prior to welding, in one of the embodiments of the present invention.

Referring to FIGS. 3, 8 and 10, between the toner frame 11 and development frame 12, the opening 81 is provided, through which toner is sent from the toner frame 11 into the development frame 12. The opening 81 is surrounded by a recessed surface 11*k*, which surrounds flange 11*j*. The top and bottom portions of the flange 11*j* are provided one for one with grooves 11*n*, which extend along the top and bottom outward edges of the flange 11*j*. The position of the bottom surface 11*n*2 of the groove 11*n* is closer to the development frame 12 than the position of the recessed surface 11*k* as shown in FIG. 13.

Figure 7:
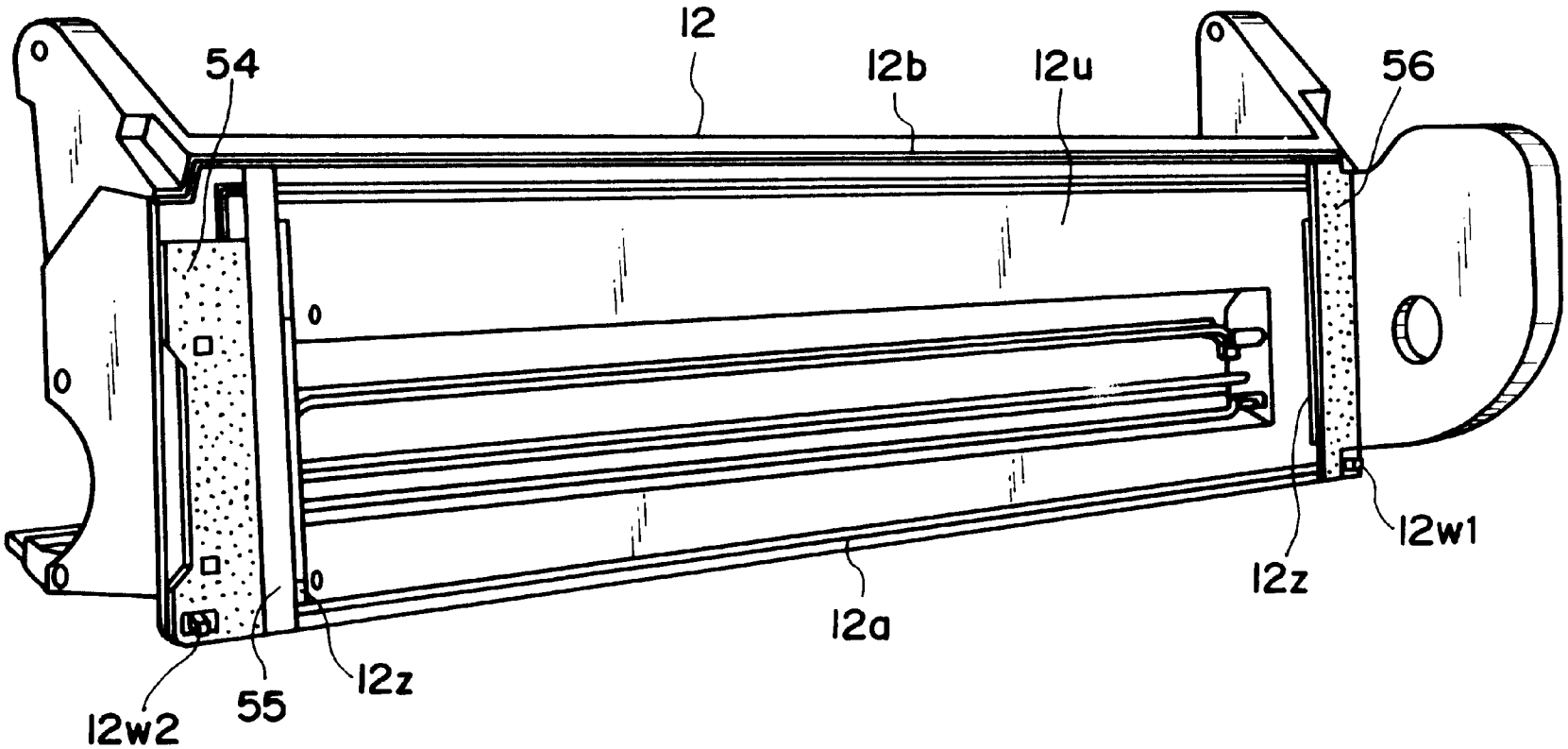
FIG. 7 is a perspective view of a development means container.

Referring to FIG. 7, the surface 12*u* of the development frame 12, which faces the toner frame 11, is a flat surface, which is surrounded by a flange 12*e* (FIG. 13) on all four sides as if it were framed. The flange 12*e* is provided with welding ribs 12*a* and 12*b*, which extend, one for one, along the longitudinal edges of the flange 12*e*. The welding ribs 12*a* and 12*b* fit in the top and bottom grooves 11*n* and 11*n* of the toner frame 11, respectively. They are provided with a triangular ridge 12*v*1, which extends on the top surface of the welding rib, and functions as a director when the two frames are joined by supersonic welding. After various components are assembled into the toner frame 11 and development frame 12, the two frames are fitted with each other so that the grooves 11*n* and 11*n* of the toner frame 11 engage with the welding ribs 12*a* and 12*b* of the development frame 12, respectively. Then, the two frames are welded together along the grooves 11*n* and 11*n* and the welding ribs 12*a* and 12*b*.

Figure 6:
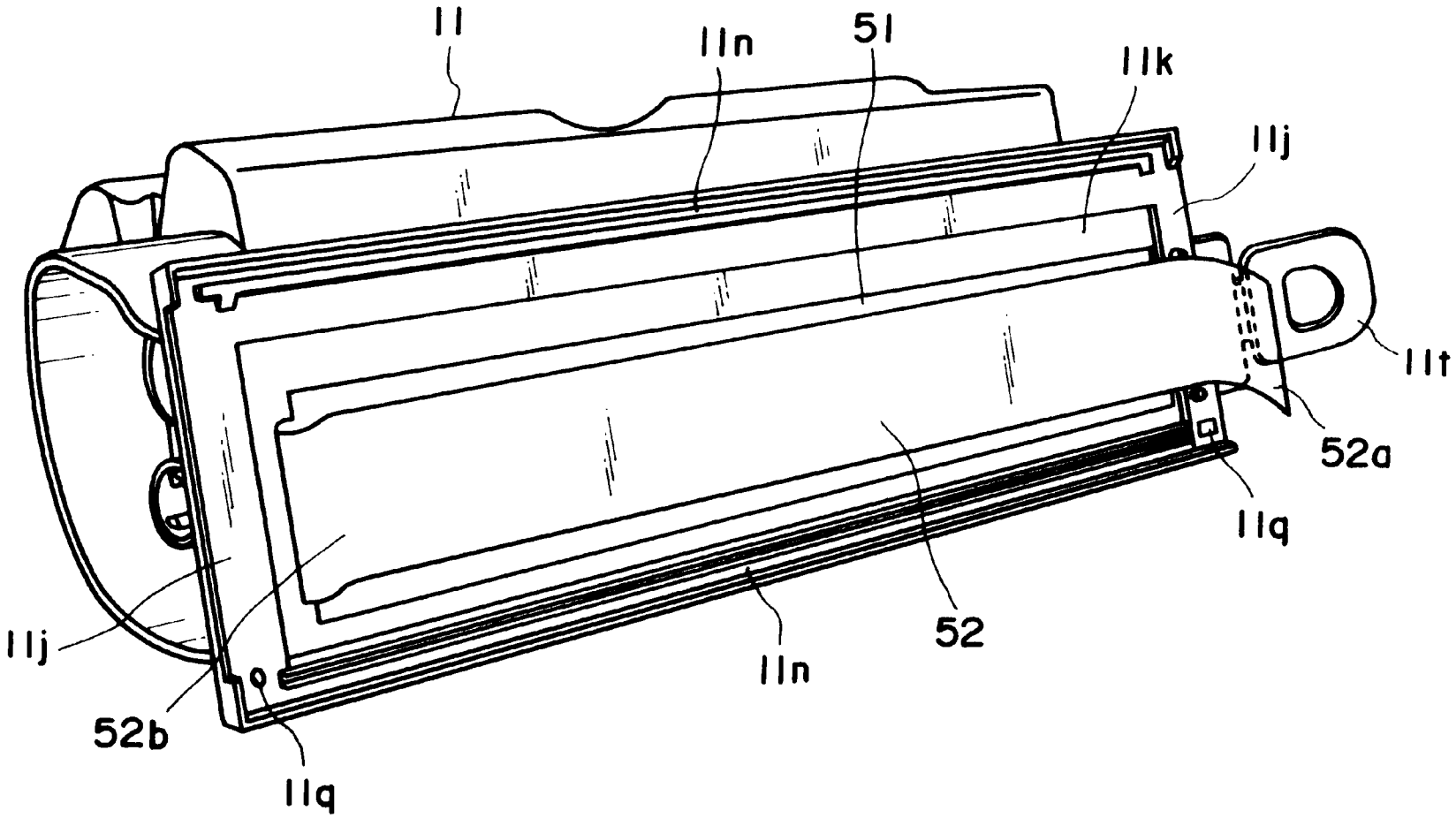
FIG. 6 is a perspective view of a developer container.

Referring to FIG. 6, the opening of the toner frame 11 is covered with a cover film 51, which is pasted to the recessed surface 11*k*, along the four edges of the opening 81. The cover film 51 is made easily tearable in the longitudinal direction, and is provided with a tear tape 52, which is welded to the cover film 51 to be used to tear open the cover film 51. The tear tape 52 is run from one of the longitudinal end of the opening 81 to the other end, and then, is folded back all the way back to the first end, from which it is extended outward between an elastic seal 54 (FIG. 7) and the toner frame 11. The elastic seal 54 is formed of elastic material, such as sponge or felt. The outwardly extended portion of the tear tape 52 is provided with a handle 11*t*, which is attached to the end portion 52*a* of the tear tape 52 (FIG. 6).

The handle 11*t* is integrally formed with the toner frame 11. The portion which connects the toner frame 11 and the handle 11*t* is formed sufficiently thin to be easily broken to separate the two components from each other. The end portion of the tear tape 52 is pasted to the handle 11*t*. On the inward side of the elastic seal 54 in terms of the longitudinal direction, a piece of tape 55 is pasted, which is formed of synthetic resin film having a low coefficient of friction. On the opposite end of the development frame 12, in terms of the longitudinal direction, the elastic seal 56 is located, which is pasted to the flange 12*e* (FIG. 7).

The aforementioned elastic seals 54 and 56 pasted on the flange 12*e* at the longitudinal ends of the development frame 12, one for one, are long enough to cover the entire width of the development frame 12. Further, they coincide, in shape, size, and location, with the flange portions 11*j* that are located on the outward side of the recessed surface 11*k*, and entirely cover the flange portion 11*j* in both width and length directions, while overlapping with the welding ribs 12*a* and 12*b* (the details of which will be given later).

In order to simplify the alignment of the toner frame 11 and the development frame 12 when joining them, the flange 11*j* of the toner frame 11 is provided with a round hole 11*r* and square hole 11*q*, which engage with the cylindrical dowel 12*w*1 and square dowel 12*w*2, respectively, with which the development frame 12 is provided. The round hole 11*r* and the cylindrical dowel 12*w*1 fit tightly, whereas the square hole 11*q* and square dowel 12*w*2 fit tightly in terms of the width direction of the process cartridge, but loosely in the longitudinal direction of the process cartridge.

Before the toner frame 11 and the development frame 12 are joined, they are independently assembled. Then, the cylindrical positioning dowel 12*w*1 of the development frame 12, and the square positioning dowel 12*w*2 of the development frame 12, are fitted into the round positioning hole 11*r* of the toner frame 11 and the square positioning hole 11 of the toner frame 11, respectively Also, the welding ribs 12*a* and 12*b*, that is, the projections, of the development frame 12 are fitted into the grooves 11*n* and 11*n* of the toner frame 11, respectively. Then, as the toner frame 11 and development frame 12 are pressed against each other, the seals 54 and 56 are compressed against the flange portions 11*j* located at the longitudinal ends of the development frame 12, and the projections 12*z* of the development frame 12 are positioned close to the flange 11*j* of the toner frame 11. The projections 12*z* are integrally formed parts of the development frame 12, and are located at the longitudinal ends of the development frame 12, extending in the width direction They play the role of a spacer. On the side from which the tear tape 52 is pulled out, the projection 12*z* comprises two pieces, which are located at corner portions, one for one, of the development frame 12, and are separated by a gap sufficiently wide for the tear tape 52 to pass.

Then, while pressing the toner frame 11 and development frame 12 against each other as described above, ultrasonic waves are applied between the welding ribs 12*a* and 12*b* and the grooves 11*n*. As a result, the aforementioned triangular ridge 12*v*1 is melted by the frictional heat, and fuses with the bottom surface 11*n*2 of the groove 11*n*. Also, the edge 11*n*1 of the groove 11*n* of the toner frame 11, and the projection 12*z*, as the spacer, of the development frame 12, come in contact with their counterparts, leaving a space between the recessed surface 11*k* of the toner frame 11 and the flat surface 12*u* of the development frame 12, in which the aforementioned cover film 51 and tear tape 52 fit.

In order to allow the toner stored in the toner frame 11 to be sent into the development frame 12, the cover film 51 must be torn to unblock the opening 81 of the toner frame 11, which is accomplished by the following steps. First, the handle 11*t* to which the end portion 52*a* of the tear tape, which is extending outward from the process cartridge B, is pasted (FIG. 6) is cut off, or torn off, from the toner frame 11, at the joint portion, that is, the portion connecting the handle 11*t* and the toner frame 11, by a user, and then, the handle 11*t* is manually pulled by the user to tear the cover film 51. Even after the removal of the tear tape 52 and the portion of the cover film 51, the process cartridge B remains satisfactorily sealed because of the presence of the elastic seals 54 and 56 at the longitudinal ends of the process cartridge B, which retain virtually the original shape, that is, the shape of a very flat regular parallelepiped, although having been deformed, that is, compressed, in terms of their thickness direction.

Since the surface of the toner frame 11, which faces the development frame 12, and the surface of the development frame 12, which faces the toner frame 11, are structured as described above, the tear tape 52 can be smoothly pulled out between the two frames 11 and 12 by pulling the tear tape 52 with a force sufficiently strong to gear the cover film 51.

When joining the toner frame 11 and the development frame 12 by ultrasonic welding, frictional heat is generated, and the triangular ridge 12*v*1 is melted by this frictional heat. This frictional heat creates a problem in that the toner frame 11 and the development frame 12 are liable to be deformed by the thermal stress from the frictional heat. However, in this embodiment, the groove 11*n* of the toner frame 11, which extends virtually; and the entire longitudinal length of the toner frame 11, and the welding ribs 12*a* and 12*b*, which extend to virtually the entire longitudinal length of the development frame 12, engage across virtually the entire length of the process cartridge B. Furthers the engaged portions are reinforced by welding. Therefore, the toner frame 11 and development frame 12 are not liable to deform due to the thermal stress.

The material for the toner frame 11 and development frame 12 are plastic, for example, polystyrene, ABS resins, that is, copolymer of acrylonitrile/butadiene/styrene, polycarbonate, polyethylene, polypropylene, and the like.

Figure 11:
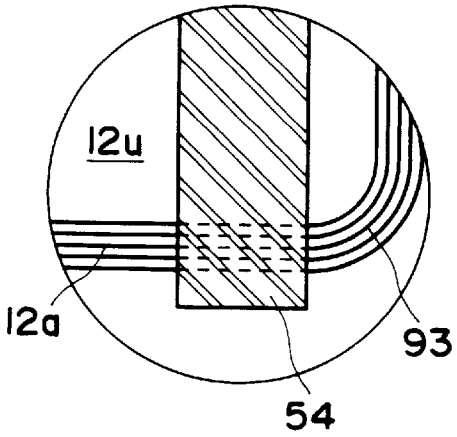
FIG. 11 is an enlarged view of the portion A in FIG. 10, (*b*).

Next, the relationship between the welding rib and the elastic seal will be described in detail. Referring to FIG. 11, which shows in detail portion A in FIG. 10, the welding rib 12*a* located at one of the longitudinal ends comprises a curved welding rib 93, which extends beyond the elastic seal 54, bends in the form of an arc, and extends perpendicular to the main portion of the welding rib 12*a*; the main portion of the welding rib 12*a* and the curved welding rib 93 are continuous to each other.

Similarly, the welding rib 12*b* and the curved welding rib 92 are continuous. In other words, the curved welding rib 92 extends across the elastic seal 54. Referring to FIG. 10, reference character L1 represents the width of the tear tape 52. The end of the welding rib 92 does not reach the tear tape 52.

Similarly, on the side of the elastic seal 56 formed of elastic material such as felt, that is, on the -side from which the tear tape 52 is not pulled out, the welding ribs 12*a* and 12*b* comprise curved welding ribs 90 and 91, which continuously extend from the main portions of the welding ribs 12*a* and 12*b*, respectively. In other words, the elastic seal 56 is crossed by the welding ribs 12*b* and 91, as well as the welding ribs 12*a* and 90.

As is described above, the welding ribs 12*a* and 12*b* are bent toward each other at their longitudinal ends.

The width of the elastic seal 54 in terms of the longitudinal direction of the development frame 12 is increased across the range (the range designated with a reference character L1 In FIG. 10), where the tear tape 52 is passed, so that the elastic seal 54 overlaps with the end portion of the curved welding rib 93.

The elastic seal 56 is rendered narrower at the longitudinal ends than across the center portion, by squarely cutting of the outward corners, and one of the narrow ends of the elastic seal 56 overlaps with the curved welding rib 90.

The edges of the elastic seals 54 and 56 coincide with the longitudinal edges 84*a* and 84*b* of the development frame 12, as shown in FIG. 10.

The toner frame 11 is provided with grooves 11*n* in which the aforementioned welding ribs 12*a*, 90 and 93, and the aforementioned welding ribs 12*b*, 91 and 92, fit correspondingly.

As the aforementioned welding ribs of the development frame 12 are fitted in the grooves of the toner frame 11, and then, they are welded together by ultrasonic welding, and the elastic seal 54 is fixed to the development frame 12 and the toner frame 11, at points B and C, which are adjacent to where the tear tape 52 is passed. As a result, the fixed portions B and C of the elastic seal 54 prevent the elastic seal 54 from moving rightward (direction in which tear tape 52 is pulled out) of the curved welding ribs 92 and 93. Therefore, when the tear tape 52 is pulled out, the elastic seal 54 is not likely to be moved by the force applied to the elastic seal 54 by the friction generated between the elastic seal 54 and the tear tape 52 Therefore, the sealing capability of the elastic seal 54 is not impaired.

In fact, the toner sealing capability of the elastic seal 54 is improved.

Although in this embodiment, the welding ribs are parts of the development frame 12, and the grooves in which the welding ribs fit are the parts of the toner frame 11, the welding ribs and grooves may be provided on the toner frame 11 and the development frame 12, respectively.

Figure 14:
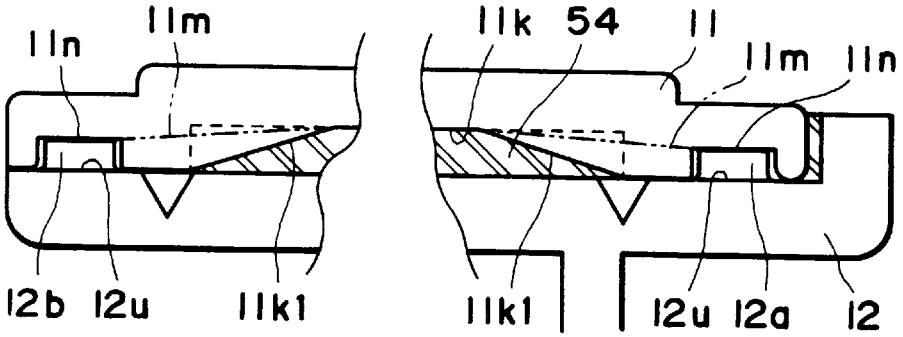
FIG. 14 is a schematic sectional view of the welding portions in FIG. 13, after welding.

As the development frame 12 to which the elastic tape 54 has been pasted with the use of a piece of double-sided adhesive tape faces the toner frame 11 as show in FIG. 13, is pressed against the toner frame 11, and is welded to the toner frame 11 by ultrasonic welding while remaining pressed against the toner frame 11, the relationship between the two frames 12 and 11 changes to the one depicted in FIG. 14. Since the toner frame 11 is provided with triangular walls with a slanted surface 11*k*1, which are located at one of the longitudinal ends of the recessed surface 11*k*, which also are the longitudinal ends of the elastic seal 54, one for one, it is assured that the elastic seal 54 firmly, that is, immovably, is attached to the toner frame 11.

Embodiment 2

Figure 12:
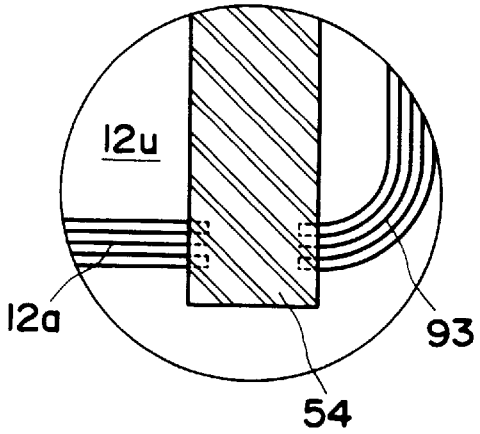
FIG. 12 is an enlarged view of a modification of the portion A in FIG. 10, (*b*).

This embodiment shows another arrangement between the welding ribs and the grooves. Otherwise, this embodiment is the same as the first embodiment. Referring to FIG. 12, which is an enlarged view of the portion designated by a reference character A in FIG. 10, the welding rib 12*a* and the curved welding rib 93 in this embodiment are not continuous. Instead, the end portion of the welding rib 12*a* overlaps with elastic seal 54 only at one of the long edges of the elastic seal 54, and the curved welding rib 93 overlaps with the elastic seal 54 only at the other long edge of the elastic seal 54. In this case, the plane that connects the bottom of the end portion of the welding rib 12*a* and the bottom of the end portion of the welding rib 93, coincides with the flat surface 12*u*. The portion of the toner frame 11 that corresponds to the portion between the two welding ribs 12*a* and 93 is provided with a groove 11*m* outlined by double dot chain lines in FIG. 14. The width of the groove 11 is such that the elastic seal 54 perfectly fits in the groove 11*m*.

According to this second embodiment, the movement of the elastic seal 54 is restricted by compressing the end portions, in terms of the width direction of the process cartridge, of the elastic seal 54. Therefore, the elastic seal 54 remains properly positioned against the force generated by the friction generated between the tear tape 52 and the elastic seal 54 as the tear tape 52 is pulled out In the preceding embodiments described above, the present invention was described with reference to a process cartridge, which comprised a developing apparatus, and was usable with a laser beam printer as an image forming apparatus. However, the application of the present invention does not need to be limited to the process cartridge described above; obviously, the present invention is also applicable to a developing apparatus or a process cartridge, usable with the toner image forming apparatuses such as an electrophotographic copying machine, a facsimile machine, or a word processor.

Also in the preceding embodiments, the present invention was described with reference to a process cartridge. However, the present invention is also applicable to a developing apparatus, which integrally comprises a development frame and a toner frame, and is independently and removably installable in the main assembly of an image forming apparatus Also in such a case, the development frame supports a development members and the toner frame contains toner and is sealed with a removable toner seal.

As described above, according to an aspect of the present invention, the welding portions of the developer chamber frame and the development chamber frame are extended beyond the elastic seal, which is placed at each of the longitudinal ends of a process cartridge or the like to airtightly seal the process cartridge Therefore, the elastic seal is reliably held in place. As a result, the possibility that toner may leak as the toner seal is pulled out is reduced.

According to another aspect of the present invention, the elastic seal is positioned in a manner to overlap with the welding portion, at both ends of the elastic seal in terms of the width direction of the process cartridge or the like, and the part of the welding portion, which extends beyond the elastic seal, is bent so that it overlaps with the long edge portion of the elastic seal, on the outward side of the process cartridge or the like. Therefore, the elastic seal is more reliably held, further reducing the possibility that toner will leak as the toner seal is pulled out.

According to another aspect of the present invention, the welding portion is modified so that it lacks the part corresponding to the central portion of the elastic seal, in terms of the longitudinal direction of the process cartridge. Therefore, the welding anomalies that occur when the developer frame and the development frame are welded together are reduced. As a result, the end portions of the elastic seal, in terms of the width direction of the process cartridge, are allowed to make more uniform contact with the surfaces of the both frames, reducing further the possibility of toner leak.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

an accommodating container for containing a developer, said container having an opening, a developing container having an opening to which the developer is supplied from said opening of said accommodating container;

a developer carrying member, provided in said developing container, for carrying the developer to a developing position; and an elastic sealing member, provided adjacent a longitudinal end of said accommodating container between said accommodating container and said developing container, for preventing leakage of the developer;

wherein said accommodating container and said developing container are welded together along the longitudinal direction, and the welded portion includes portions which cross ends of said elastic sealing member in the longitudinal direction.

2. An apparatus according to claim 1 wherein the welded portion is provided with a welding rib.

3. An apparatus according to claim 2, wherein said developing container is provided with the welding rib.

4. An apparatus according to claim 2, wherein said accommodating container is provided with the welding rib.

5. An apparatus according to claim 1, wherein said welded portion is provided by ultrasonic welding.

6. An apparatus according to claim 1, wherein said elastic sealing member is provided adjacent to each of the longitudinal ends of said accommodating container.

7. An apparatus according to claim 1, wherein said welded portion crosses throughout said elastic sealing member in the longitudinal direction.

8. An apparatus according to claim 1, wherein said welded portion crosses both ends of said elastic sealing member except for a central, portion of said elastic sealing member in the longitudinal direction.

9. An apparatus according to claim 1, wherein the welded portion is provided with a portion extending in a direction crossing with the longitudinal direction longitudinally outside of said elastic sealing member.

10. An apparatus according to claim 1, further comprising a film covering said opening of said accommodating container, wherein when said film is opened, said film is pulled out while being pressed by said elastic sealing member.

11. An apparatus according to claim 1, wherein said elastic sealing member is a sponge.

12. An apparatus according to claim 1, wherein said developing apparatus is detachably mountable to an image forming apparatus.

13. An apparatus according to any one of claims 1 to 12, wherein said developing apparatus is provided in a process cartridge detachably mountable to an image forming apparatus, and said process cartridge contains said Image bearing member.

14. An apparatus according to claim 13, wherein said image bearing member is an electrophotographic photosensitive member.

15. An apparatus according to claim 10, wherein a direction in which the welded portion crosses with said elastic sealing member is substantially the same as a direction in which the film is pulled.

* * * * *

UNITED STATES PATENT AND TRADEMARK OFFICE

CERTIFICATE OF CORRECTION

PATENT NO. : 6,205,305 B1
DATED : March 20, 2001
INVENTOR(S) : Akira Suzuki et al.

It is certified that error appears in the above-identified patent and that said Letters Patent is hereby corrected as shown below:

Title page,
Item [73] Assignee, "Canon Kaubshiki Kaisha," should read -- Canon Kabushiki Kaisha, --.

Column 2,
Line 31, "it" should read -- is --.
Line 60, "invention; ill" should read -- invention will --.

Column 3,
Line 21, "Image" should read -- image --.
Line 27, "beater" should read -- heater --.
Line 48, "comprises," should read -- comprises --.

Column 4,
Line 21, "one" should read --, one --.
Line 22, "one" should read -- one, --.

Column 5,
Line 29, "respectively" should read -- respectively. --.

Column 6,
Line 22, "virtually; and" should read -- virtually to --.
Line 26, "Furthers" should read -- Further --.
Line 50, "-side" should read -- side --.

Column 7,
Line 20, "52" should read -- 52. --.
Line 68, "out" should read -- out. --.

Column 8,
Line 18, "apparatus" should read -- apparatus. --.
Line 19, "members and" should read -- member, and --.
Line 26, "cartridge" should read -- cartridge. --
Line 56, "opening" should read -- opening; --.
Line 66, "developer;" should read -- developer, --.

UNITED STATES PATENT AND TRADEMARK OFFICE

CERTIFICATE OF CORRECTION

PATENT NO. : 6,205,305 B1
DATED : March 20, 2001
INVENTOR(S) : Akira Suzuki et al.

It is certified that error appears in the above-identified patent and that said Letters Patent is hereby corrected as shown below:

Column 10,
Line 16, "Image" should read -- image --.

Signed and Sealed this

Eighth Day of January, 2002

*Attest:*

*Attesting Officer*

JAMES E. ROGAN
*Director of the United States Patent and Trademark Office*